United States Patent [19]

Deborde

[11] 4,290,460

[45] Sep. 22, 1981

[54] ACTIVE AUXILIARY NOZZLE FOR A SHUTTLE-LESS LOOM WITH PNEUMATIC WEFT INSERTION

[75] Inventor: Albert H. Deborde, Bourgoin-Jailleu, France

[73] Assignee: Saurer-Diederichs, Bourgoin-Jailleu, France

[21] Appl. No.: 14,688

[22] Filed: Feb. 23, 1979

[30] Foreign Application Priority Data

Aug. 1, 1978 [FR] France ..... 78 23205

[51] Int. Cl.[3] ..... D03D 47/30

[52] U.S. Cl. ..... 139/435; 226/97

[58] Field of Search ..... 139/435; 226/97

[56] References Cited

U.S. PATENT DOCUMENTS 3,139,118 6/1964 Suaty et al. ..... 139/435

3,161,209 12/1964 Scheffel ..... 139/435

3,367,373 2/1968 Fransen ..... 139/435

FOREIGN PATENT DOCUMENTS 2332914 2/1975 Fed. Rep. of Germany ..... 139/435

*Primary Examiner*—Henry Jaudon

*Attorney, Agent, or Firm*—Karl F. Ross

[57] ABSTRACT

In a shuttle-less loom in which a pick of weft is inserted into the shed of warp yarns by a jet of compressed air from an insertion nozzle to one side of the shed, a plurality of spaced auxiliary nozzles are provided along the weft path through the shed. Each auxiliary nozzle has a horizontal slot directly below the weft path, and a vertical slot at one or both ends of the horizontal slot adjacent the respective lower end of the vertical slot. The slots face in the direction in which the weft travels and are supplied with compressed air to provide a lower substantially horizontal flat jet of air from the horizontal slot and one or two lateral jets from the respective vertical slot, so that the air jets serve to guide, support and augment the propulsion of the weft.

16 Claims, 16 Drawing Figures

ACTIVE AUXILIARY NOZZLE FOR A SHUTTLE-LESS LOOM WITH PNEUMATIC WEFT INSERTION

FIELD OF THE INVENTION

The present invention relates to an active auxiliary nozzle for a shuttle-less loom with pneumatic insertion of the weft yarn. It relates more particularly to looms of the "single phase" type using, for the insertion of the weft yarn, a pneumatic system comprising an insertion nozzle located on one side of the machine and an arrangement of auxiliary nozzles located downstream of said insertion nozzle, making it possible to guide and draw the weft yarn until it reaches the other side of the machine, at the end of insertion.

BACKGROUND OF THE INVENTION

Looms of the above described type are already known which are equipped with so-called "active" auxiliary pulling nozzles, but the devices currently in existence all have drawbacks when in use. It is possible to distinguish between two types of devices:

those with numerous annular nozzles which are subject to rapid wear by friction on the warp threads at the time of insertion, the requirements of lightness, strength and hardness being irreconcilable for these nozzles; and those using spaced nozzles with a special comb in the form of a channel for ensuring confinement of the weft pick.

There are also known pneumatic insertion systems without active auxiliary nozzles, but blowing by means of a sheet of air at the level of the lower shed of warp threads.

None of the known devices is satisfactory when using a conventional comb.

OBJECTS OF THE INVENTION

The present invention intends to remedy these drawbacks and its purpose defined in this way is thus to provide an active auxiliary nozzle which is not subject to rapid wear and is compatible with a normal comb, while ensuring the stability of the yarn which is drawn along. More generally, the invention also intends to provide a system for the pneumatic insertion of the weft yarn at high speed and with a low power consumption, relative to its performances, the supply of which power takes place at average pressures of 1 to 4 bars, while making it possible to obtain significant pulling forces.

SUMMARY OF THE INVENTION

To this end, the active auxiliary nozzle of the invention essentially comprises a chamber connected to a source of compressed air and connected to the outside by a horizontal air outlet slot and by at least one vertical air outlet slot, in order to create, downstream of the auxiliary nozzle, a substantially horizontal lower flat jet and at least one lateral flat jet which is substantially parallel to the comb of the machine.

This auxiliary nozzle creates a fluidized channel for pulling and guiding the weft pick, limited laterally by at least one flow in the form of a "curtain", at the top through the upper shed of warp threads and at the bottom through the lower shed of warp threads as well as by a flat jet forming a fluidized bed for pulling and supporting the weft pick, the arrangement defining a space for pulling the weft yarn with a single counterbalancing area located close to the lower shed of warp threads. The invention makes it possible to envisage the insertion of threads whose titre varies between 50 and 200 dtex, at possible speeds of the order of 1100 meters per minute, without it being necessary to provide auxiliary nozzles at excessively close intervals.

According to a first embodiment of the invention, the horizontal air outlet slot is enclosed by two vertical air outlet slots, with a U-shaped configuration, in order to create, downstream of the auxiliary nozzle, a lower flat jet and two lateral flat jets. The two lateral jets serve for guiding and in a secondary manner participate in pulling the yarn, whereas the lower jet serves simultaneously as the main pulling means by a dragging effect and as a fluidized bed for the moving yarn.

Advantageously, the two vertical air outlet slots are arranged along planes which are slightly convergent, which enables the weft yarn to arrive in the median plane of the next active auxiliary nozzle, while giving the yarn a trajectory located in the vicinity of the lower jet. The angle of convergence may be of the order of 4° to 10°.

In this embodiment, it is possible to envisage either two perfectly symmetrical vertical air outlet slots, creating two lateral jets with the same capacity, or two asymmetrical slots, creating two lateral jets of different capacities, for example in a ratio of between 1.3 and 2.0, the jet of lower capacity "attaching itself" to the preponderant jet.

According to another embodiment of the invention, the auxiliary nozzle comprises a single vertical air outlet slot located adjacent that end of the horizontal slot which is remote from the comb so that the two slots are in an L-shaped configuration. In this embodiment, which is basically asymmetrical, the pulling and guiding channel is limited laterally, on one side, by the "curtain-like" flow of air created by the single vertical slot and, on the opposite side, by the porous wall constituted by the comb. Correct operation is guaranteed, in the case of an ordinary comb, by the fact that the latter creates considerable pressure drop by an "elbow" effect and by the fact that the porosity of the comb is virtually constant whatever the titre of the yarn. The single lateral jet is thus sufficient for confinement and guidance. In the case where a special comb would be used, it would still be possible to use the previously described symmetrical embodiment, which allows operation independent of the characteristics of the comb.

According to another feature of the invention, the horizontal air outlet slot is constructed in order to direct the lower jet slightly downwardly. Naturally, this slightly "dipping" jet may be obtained simply by a corresponding orientation of the horizontal slot. However, according to a preferred embodiment, the horizontal slot is extended by a concave wall ensuring, by the effect of flow attachment to this wall, a deflection of the lower jet through the desired inclination. One thus obtains an asymmetrical cross-section of speeds, such that the weft yarn drawn along is in the maximum shearing area of the jet. The angle of inclination of the lower jet may be of the order of 4° to 8°.

The active auxiliary nozzle according to the invention, preferably comprises a recessed solid part provided with means for attachment to the comb support and of at least one thin-walled part attached to the solid part and defining at least one vertical air outlet slot, an orifice to which a compressed air supply pipe is connected being provided in the solid part.

According to one embodiment, the solid part is open at the top, but closed-off by another thin detachable part which, with a wall of concave shape of the solid part, defines the horizontal air outlet slot. One thus obtains the configuration allowing the formation of the lower jet by the effect of attachment to a wall.

According to a further embodiment, the solid part is open on its front portion and two thin added parts attached by sticking define both the horizontal air outlet slot and the vertical air outlet slot or slots. This solution, allowing the use of simple shaped metal sheets, can lead to a lower cost price.

Advantageously, the said solid part is made and arranged so as to create local lifting of the lower shed of warp threads upstream of the auxiliary nozzle.

BRIEF DESCRIPTION OF THE DRAWING

The invention will now be further described, by way of example, with reference to the accompanying drawing illustrating embodiments of the active auxiliary nozzle formed according to the invention and illustrating its operation. In the drawing.

SPECIFIC DESCRIPTION

Figure 1:
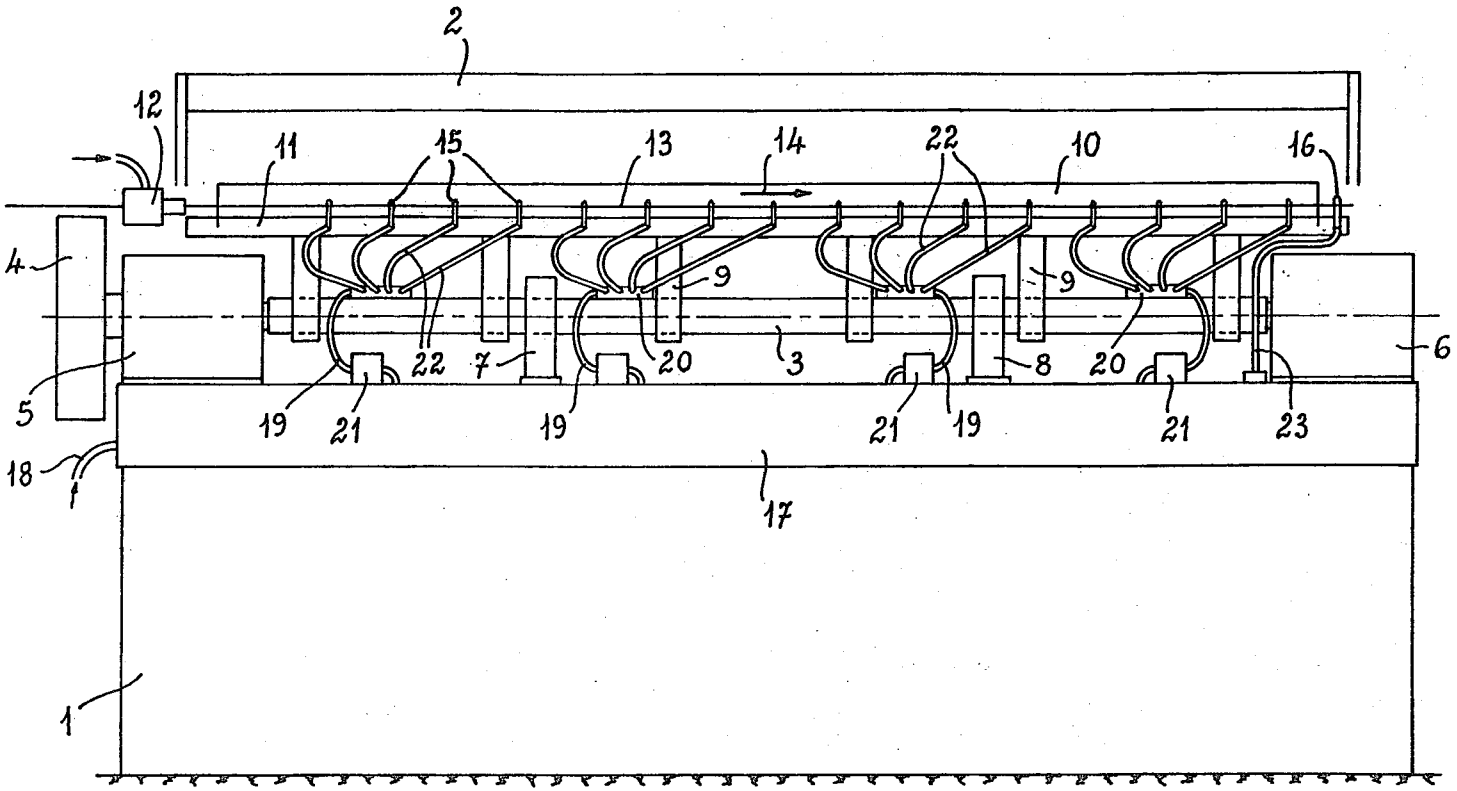
FIG. 1 is a diagrammatic front view of the arrangement of active auxiliary nozzles formed according to the invention on a loom, as well as a system for supplying these auxiliary nozzles with compressed air.

FIG. 1 diagrammatically shows a single phase loom equipped with a pneumatic weft insertion device. This figure shows the outlines of the frame 1 of the loom, a heddle frame 2, the bottom shaft 3 with its control pulley 4, its cam boxes 5 and 6, its intermediate bearings 7 and 8 and the batten levers 9, the comb 10, the comb support 11 and the insertion nozzle 12 for the insertion of the weft yarn 13 in the direction of arrow 14.

The invention relates to the construction of the active auxiliary nozzles 15 for pulling the weft yarn 13, which nozzles are located between the insertion nozzle 12 and the opposite side of the loom, where a nozzle 16 may be provided, permanently supplied with compressed air and serving to tension the yarn 13 after insertion. The auxiliary nozzles 15 are fixed at regular or irregular intervals to the comb support 11, on the front side of the latter. All the auxiliary nozzles 15 are supplied with compressed air from a manifold beam 17, adjoining which at 18 is a conduit for the supply of compressed air regulated by a pressure relief valve which is not shown. Several conduits 19, extending from the reservoir beam 17, connect the latter to distributors 20 before which they pass through supply valves 21 controlled electrically or mechanically by cams. Several supply conduits 22 leave each distributor 20 and each conduit runs to one of the auxiliary nozzles 15. The nozzle 16 is supplied by an additional conduit 23 which connects the latter directly to the reservoir beam 17.

Figures 2, 3, 4:
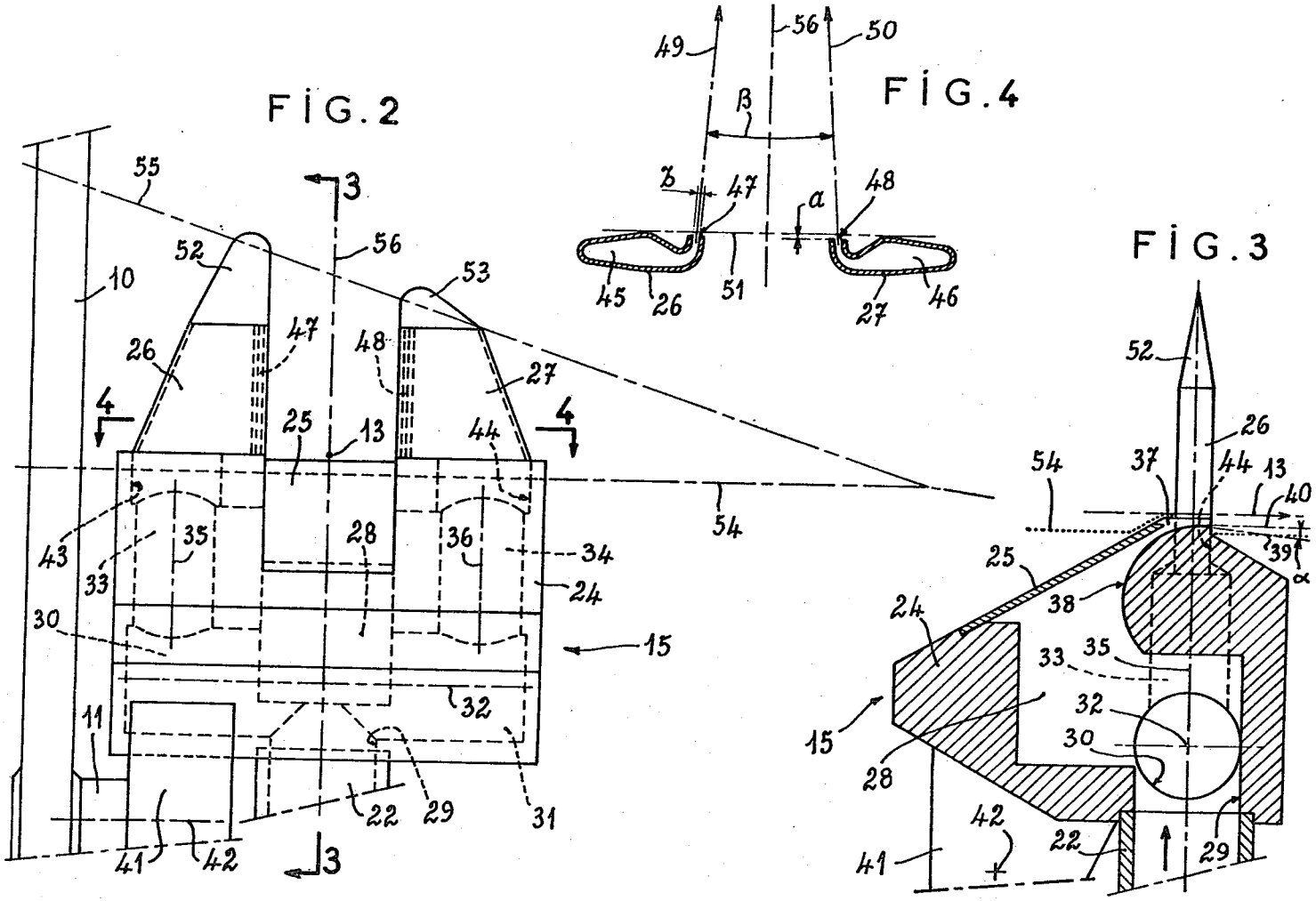
FIG. 2 shows a first embodiment of auxiliary nozzle formed according to the invention, seen from the upstream side.
FIG. 3 is a vertical cross-sectional view on line 3—3 of FIG. 2.
FIG. 4 is a horizontal sectional view on line 4—4 of FIG. 2.

In a first embodiment, illustrated in FIGS. 2 to 4, the auxiliary nozzle 15 according to the invention is composed mainly of a machined solid part 24 and of three parts 25, 26 and 27 of shaped thin sheet metal, added to the solid part and fixed by welding or sticking for example.

This part 24 comprises a central recess 28, a lower orifice 29 on a vertical axis, causing said recess to open to the outside and two channels 30 and 31 on the same horizontal axis 32, which start from the central recess 28 and are respectively extended upwards by two other lateral channels 33 and 34 on respective vertical axes 35 and 36.

The supply conduit 22, leading to the auxiliary nozzle 15 in question, is connected to the outlet of the lower orifice 29.

The central recess 28 also opens onto the outside through the upper portion of the part 24 which is open. However, one of the added sheet metal parts 25, in the form of a rectangular plate, closes-off the upper portion of the part 24 almost completely, leaving only an outlet slot 37 oriented horizontally. It should be noted that this slot 37 is defined by the plate 25, having an inclined arrangement and by a wall 38 of concave shape, shown clearly in FIG. 3, which defines the front upper part of the recess 28, the tangent plane 39 at the front end of this wall forming an angle $\alpha$ of the order of 4° to 8° with the horizontal plane 40. The consequences of these features for the operation of the auxiliary nozzle 15 will be described hereafter.

In its lower portion, the solid part 24 comprises a tab 41 facilitating the attachment of the auxiliary nozzle to the comb support 11, by means of a screw symbolized by its axis 42.

The two other added parts 26 and 27 of sheet metal are introduced into respective housings 43 and 44 provided in the upper portion of the solid part 24, opening into the base of which are the vertical channels 33 and 34 respectively. As shown in particular in FIG. 4, the two added parts 26 and 27 define respective chambers 45 and 46, the cross-section of which decreases in an upwards direction, which each open to the outside through a vertical slot 47 and 48 respectively, facing downstream. These two slots 47 and 48 are orientated along vertical planes 49 and 50 which converge slightly, the angle of convergence $\beta$ being of the order of 4° to 10°. In addition, the two slots 47 and 48 are set back by a certain distance a with respect to the transverse plane 51 tangential to the front faces of the two parts 26 and 27, in order to prevent engagement of the warp threads.

The horizontal slot 37 and the two vertical slots 47 and 48 form a U-shaped configuration. Their width b, in particular as regards the vertical slots 47 and 48, is of the order of 0.3 to 1.0 mm.

Finally, the added parts 26 and 27 are terminated, at their tops, by pointed sections of unequal heights, respectively 52 and 53, the point 52 located closest to the comb 10 being the highest.

FIGS. 2 and 3 also show the arrangement with respect to the auxiliary nozzle 15, during the transfer of the weft yarn, of the lower shed 54 of the warp threads, of the upper shed 55 of the warp threads and of the weft thread 13. The warp threads are separated into "upstream" and "downstream" threads by the parts 26 and 27 and their respective points 52 and 53. The lower shed 54 is located substantially at the height of the upper portion of the solid part 24. As shown in FIG. 3, the shape of this upper portion is such that it causes local lifting of the warp threads, at the front of the upstream threads, so that the horizontal slot 37 opens out below the upstream threads, but above the downstream threads. The upper shed 55 passes at the height of the points 52 and 53, so that the two vertical slots 47 and 48 open out between the lower shed 54 and the upper shed 55 of the warp threads. The weft thread 13 passes in the vertical plane of symmetry 56 of the auxiliary nozzle 15, close to the lower shed 54, the weft thread being retained in this position during insertion according to a process which will be described hereafter.

It should be noted that in the operating cycle of the loom, when the opening of the two sheds 54 and 55 is maximum, the points 52 and 53 of each auxiliary nozzle should still reach the level of the upper shed of threads 55, or project slightly beyond this shed, in order to prevent any possible escape of the weft thread 13 which has just been inserted.

Figure 5:
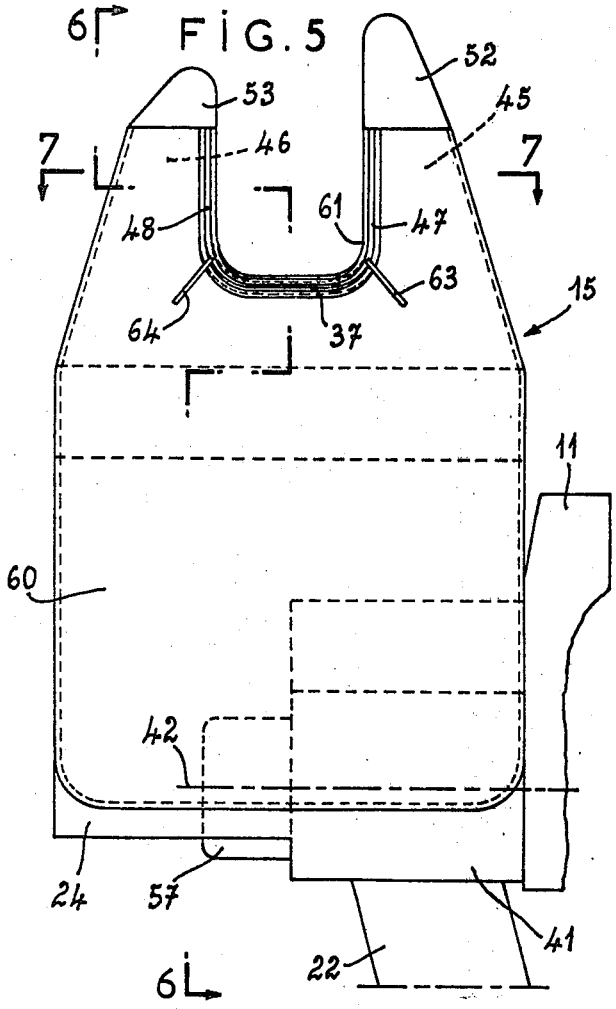
FIG. 5 shows a second embodiment of auxiliary nozzle formed according to the invention, seen from the downstream side.
Figure 6:
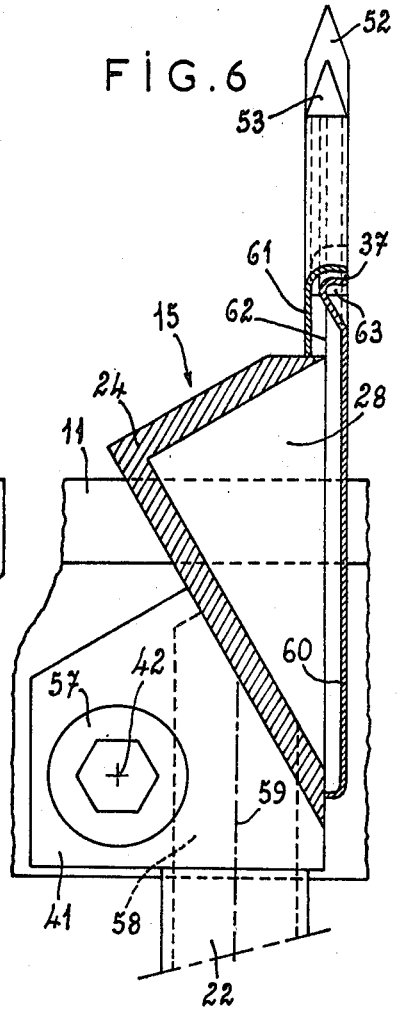
FIG. 6 is a vertical sectional view on line 6—6 of FIG. 5.
Figure 7:
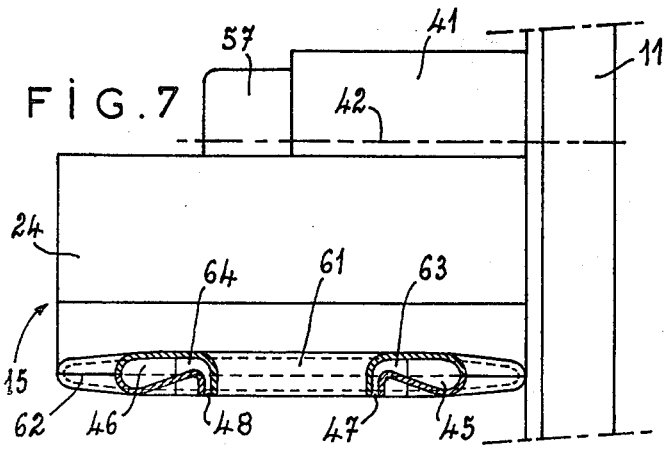
FIG. 7 is a horizontal sectional view on line 7—7 of FIG. 5.

FIGS. 5 to 7 show a second embodiment of the auxiliary nozzle 15 according to the invention, still composed mainly of a machined part 24 serving as a support and supply means and added parts of shaped thin sheet metal.

The machined part 24 in this case also comprises a central recess 28, but the latter opens onto the outside through the front portion of said part, as shown in FIG. 6. A tab 41 extending the part 24 downwards, serves for the attachment of the auxiliary nozzle to the comb support 11, by means of a screw 57 whose axis is shown at 42. A channel 58 on the vertical axis 59 thus passes through the tab 41 in question, which channel 58 opens at one end into the recess 28 and at the other end onto the lower face of the tab 41, where the supply conduit 22 is connected.

The recess in the part 24 is closed-off, at the front, by an inserted member 60 in the form of a thin vertical sheet metal plate, secured against the part 24 by its lower and lateral concave edges, but extending upwards above the part 24, the part of the plate 60 located above the part 24 having a general U-shape as shown in FIG. 5. Another U-shaped inserted sheet metal plate 61 is fixed above the part 24, at the rear of the said plate 60 to which it is connected along a joint plane 62. The two plates 60 and 61 thus define a shallow space which is connected to the recess 28 and which opens to the outside through a large U-shaped slot, opening downstream. Two strips 63 and 64 divide this large slot into a lower horizontal slot 37 and two vertical lateral slots 47 and 48. The parts of the two plates 60 and 61 which form the chambers 45 and 46, whose cross-section decreases in an upwards direction and which open to the outside through the slots 47 and 48, are terminated by points 52 and 53 respectively and it will be understood that this embodiment thus constitutes the equivalent of that described previously with reference to FIGS. 2 to 4 and may have the same features. In particular, the planes of the two vertical slots 47 and 48 are still slightly convergent and the slot 37, although of modified shape, is still arranged in order to produce a slightly descending jet.

Figure 8:
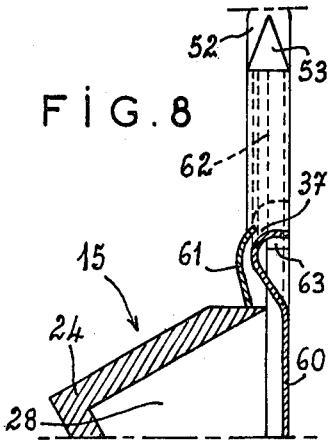
FIG. 8 is a view similar to FIG. 6 but is a fragmentary view, illustrating a variation of the auxiliary nozzle of FIGS. 5 to 7.

However, in a possible variation illustrated in FIG. 8, the shape of the horizontal slot 37 may be closer to that shown in FIG. 3. With respect to the embodiment of FIGS. 5 to 7, the plate 60 defining the lower edge of the slot 37 has not been changed, but the plate 61 has been shortened such that the upper edge of the slot 37 is set back.

In all the examples described hitherto, the auxiliary nozzle supplied with compressed air through its supply conduit 22 simultaneously produces a lower thin jet of air which is substantially horizontal, emerging from the horizontal slot 37 and two flat vertical jets of air emerging from the lateral slots 47 and 48. Because of the orientation of these slots, the vertical jets are slightly convergent, whereas the lower jet dips slightly. The operation is llustrated by FIGS. 9 and 10.

Figure 9:
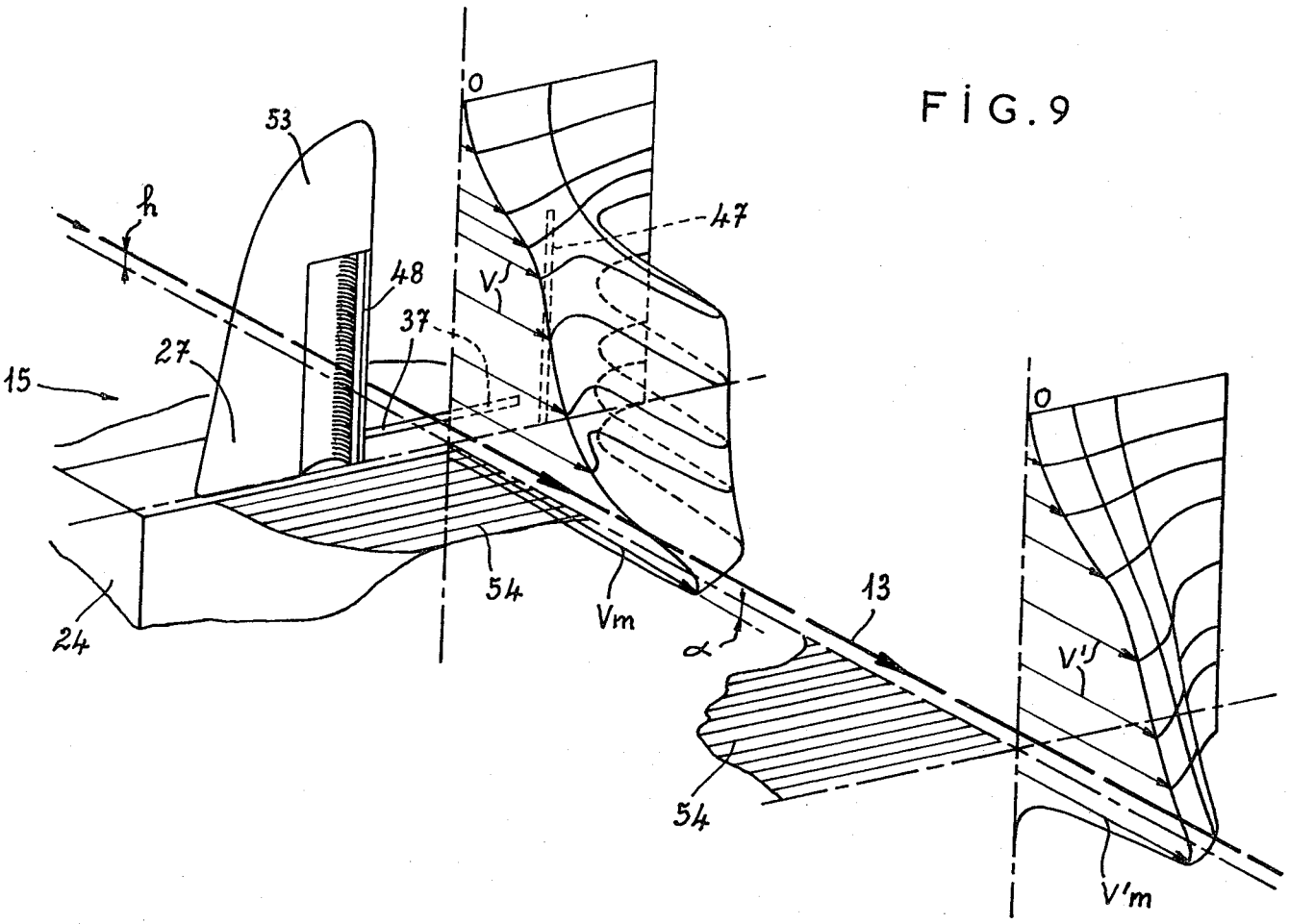
FIG. 9 is a diagram of air speeds, in the plane of an auxiliary nozzle in FIGS. 2 to 8 and at a mid-point between two such auxiliary nozzles.

FIG. 9 shows the nature of the air speeds V in the plane of one auxiliary nozzle 15 (in fact it is a question of speeds obtained just downstream of the slots 37, 47 and 48) and air speeds V′ between two consecutive auxiliary nozzles, at a mid-point between the latter. It will be seen that in the region of an auxiliary nozzle, the flow is in the form of a "curtain", the area of maximum speeds Vm corresponding to the positions of the three slots 37, 47 and 48, whereas at a mid-point between two auxiliary nozzles 15, the area of maximum speeds V′m is located in the plane of passage of the weft yarn 13, close to the lower shed 54 of the warp threads. Between the two positions shown, the two lateral jets mix, centering the weft thread 13 and giving it greater energy. Distribution of the speeds V′ at a mid-point between two auxiliary nozzles 15 is substantially maintained until approaching the second auxiliary nozzle, which makes it possible, just upstream of the latter, to place the weft thread 13 along the axis, at a slight height h above the lower shed 54 of the warp threads. The distribution of speeds is still such that the weft thread 13 is held down in the area of maximum pulling force.

Figure 10:
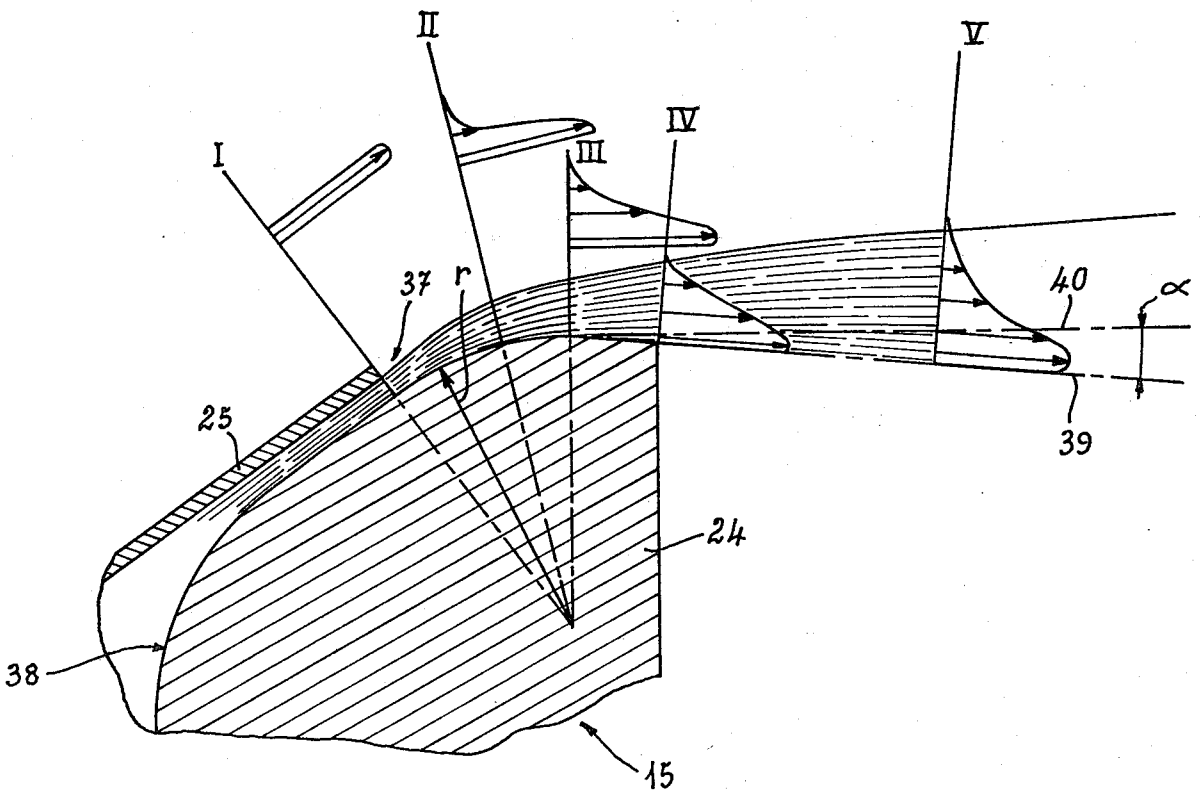
FIG. 10 is another diagram showing the development of the cross-section of speeds of the lower jet.

FIG. 10 shows the process for the formation of the lower flat jet, in the most interesting case which is that corresponding to the embodiment of FIGS. 2 to 4 (or to the equivalent variation of FIG. 8). This FIG. 10 illustrates the development of the cross-section of the air speeds, by indicating this cross section in five successive transverse planes numbered in roman numerals from I to V.

In the plane I corresponding to the slot 37, i.e. at the front edge of the plate 25, the shallow jet is initially directed upwards, according to the inclination of the plate 25. Then, by attachment to the concave wall 38 of radius r of the part 24, this jet is directed horizontally, its change of direction taking place progressively as indicated at II. As shown by positions III and IV, the attachment of the jet to the wall 38, at the same time that it re-orientates the jet, gives the latter an asymmetrical cross section of speeds, such that there is greater mixing above the jet than below. The front edge of the wall 38, inclined downwards by an angle $\alpha$ of several degrees, as described above, gives the desired inclination to the area of maximum speeds. Finally, V indicates the cross-section of the speeds obtained downstream of the auxiliary nozzle 15.

One thus obtains a "parietal" jet which serves as a fluidized bed, inclined in a downwards direction by a slight angle in order that the weft thread 13 is subject to maximum shearing force and that there is no danger of obtaining a distribution of the speeds the maximum of which tends to cause the thread to rise in the shed.

The entire arrangement described and the jets contribute to creating a descending current of fluid at low speed and an area of maximum speeds located on the axis of the auxiliary nozzles 15, thus providing a flow inside the shed, such that the weft thread 13 is able to occupy solely a single stable position, close to the lower shed 54 of the warp threads and in the plane of symmetry 56 of the auxiliary nozzles 15.

Figures 11, 12, 13:
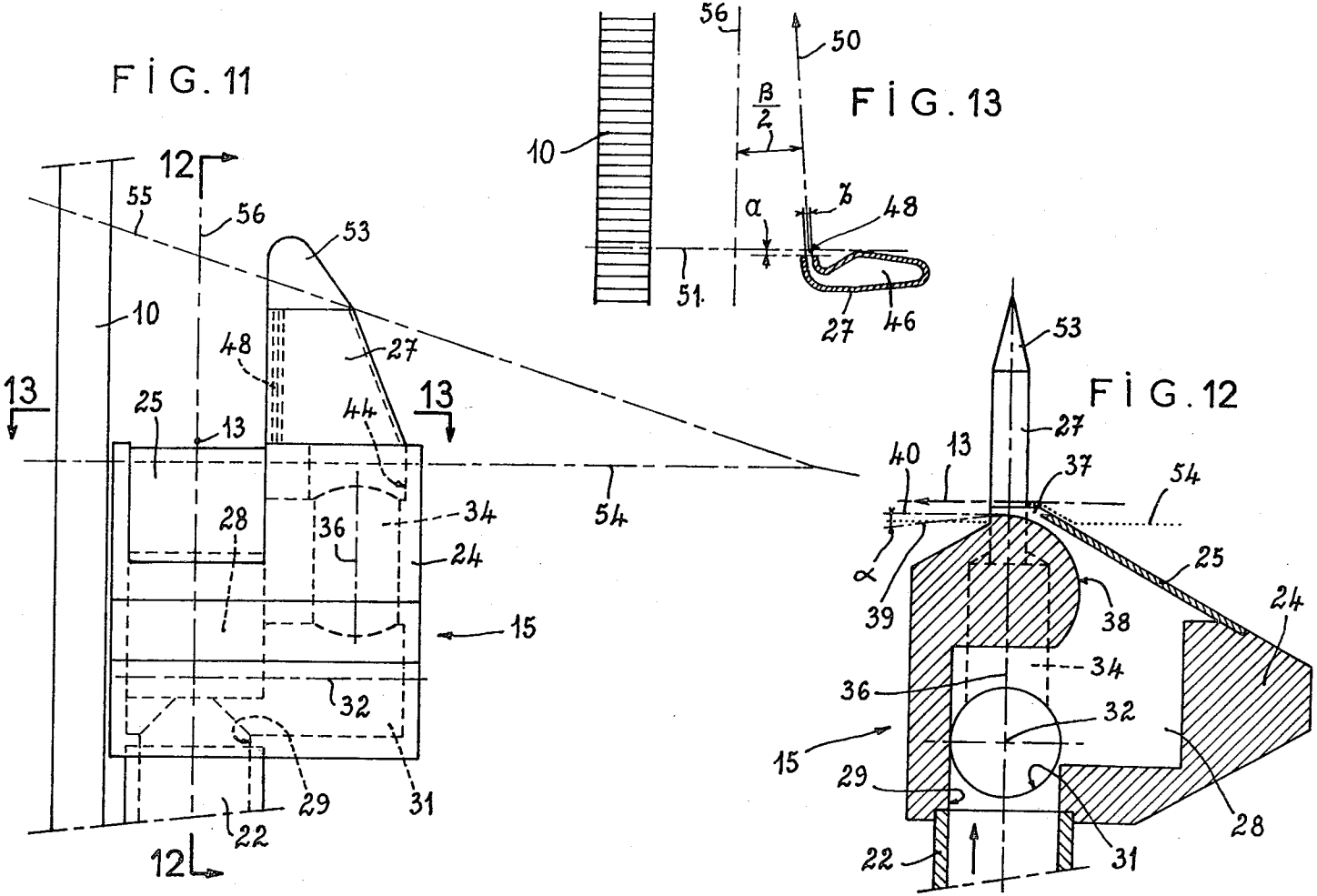
FIG. 11 shows a third embodiment of an auxiliary nozzle formed according to the invention, seen from the upstream side.
FIG. 12 is a vertical sectional view on line 12—12 of FIG. 11.
FIG. 13 is a horizontal sectional view on line 13—13 of FIG. 12.

FIGS. 11 to 13 show a third embodiment of the auxiliary nozzle 15 according to the invention which, contrary to the former, is not symmetrical.

In this case, the auxiliary nozzle 15 is still composed essentially of a machined solid part 24, comprising a central recess 28 and inserted members of thin sheet metal. A lower orifice 29 connects the recess 28 to the outside and as previously, facilitates the connection of the supply conduit 22, but a single channel 31 on the horizontal axis 32 starts from one side of the recess 28 and is extended upwards by another channel 34 on the vertical axis 36.

The upper open portion of the part 24 is closed-off by an inserted plate 25 which defines a horizontal slot 37 with the concave wall 38 of the recess 28, according to an arrangement which has not been altered with respect to the embodiment of FIGS. 2 to 4, in particular as regards the angle $\alpha$.

Fixed to the upper portion of the solid part 24 is a single sheet metal member 27, introduced into a housing 44, opening into the base of which is the vertical channel 34 and defining a chamber 46 whose section decreases in an upwards direction, opening to the outside through a vertical slot 48 which provides an L-shaped configuration with the first slot 37. In a manner similar to the first embodiment, this single vertical slot may be set back by a certain distance a, with respect to the transverse plane 51 tangential to the front face of the member 27. It has a width b of between 0.3 and 1.0 mm and converges slightly with the plane 56 parallel to the comb 10, according to an angle $\beta/2$ of the order of 2° to 5°.

The solid part 24 is secured by connecting members which are not shown, in a position very close to the comb 10 and such that the inserted member 27 is located on the side opposite the comb 10.

As shown in the drawing, the weft thread 13 passes substantially at a mid-point between the comb 10 and the slot 48, at a low height above the lower shed 54 of warp threads, whereas the upper shed 55 of warp threads is separated into two by the terminal point 53 of the inserted member 27.

Figure 15:
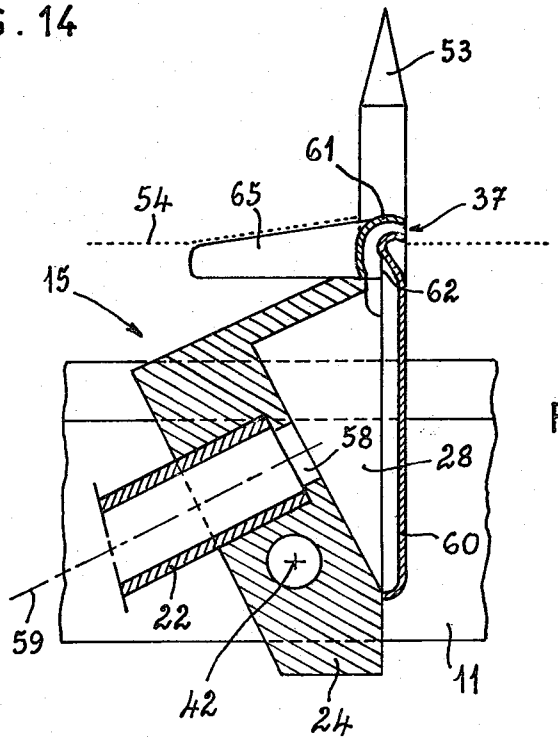
FIG. 15 is a vertical sectional view on line 15—15 of FIG. 14.
Figure 14:
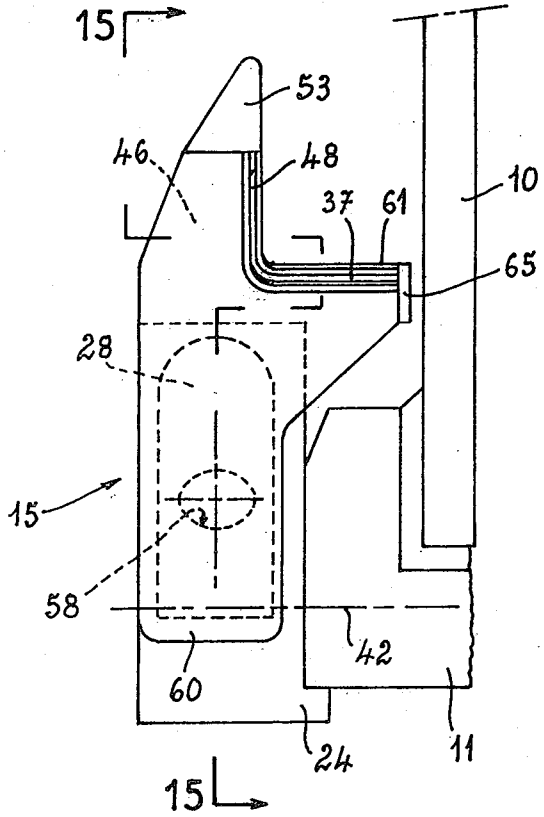
FIG. 14 shows a fourth embodiment of an auxiliary nozzle formed according to the invention, seen from the downstream side.

Finally, FIGS. 14 and 15 show a fourth embodiment of the auxiliary nozzle 15 according to the invention, which preserves the asymmetrical arrangement of the embodiment of FIGS. 11 to 13, but has a structure closer to the embodiment of FIGS. 5 to 8.

In fact, the auxiliary nozzle 15 in question, is composed of a machined part 24 with a recess 28, open at the front, of an inserted sheet metal member 60 which closes-off the opening in the part 24 and of another sheet metal member 61 connected along an interface 62 to the member 60 and defining with the latter, a horizontal slot 37 and a vertical slot 48 forming an L-shaped configuration. The part 24 still serves as a support and supply means. To this effect, it is fixed by a screw on the axis 42, against the comb support 11, such that the slot 48 is located on the opposite side to the comb 10 and a channel 58 passes therethrough, to which channel the supply conduit 22 is connected. The sheet metal parts terminate in a point 53, as previously and the slots 37 and 48 which they define may have the various features described above. In addition, a wing 65 is fixed parallel to the comb 10, on the sheet metal parts, at the end of the horizontal slot closest to the comb. This wing 65 extends upstream of the auxiliary nozzle 15 and serves to support the lower shed 54 of the warp threads.

Figure 16:
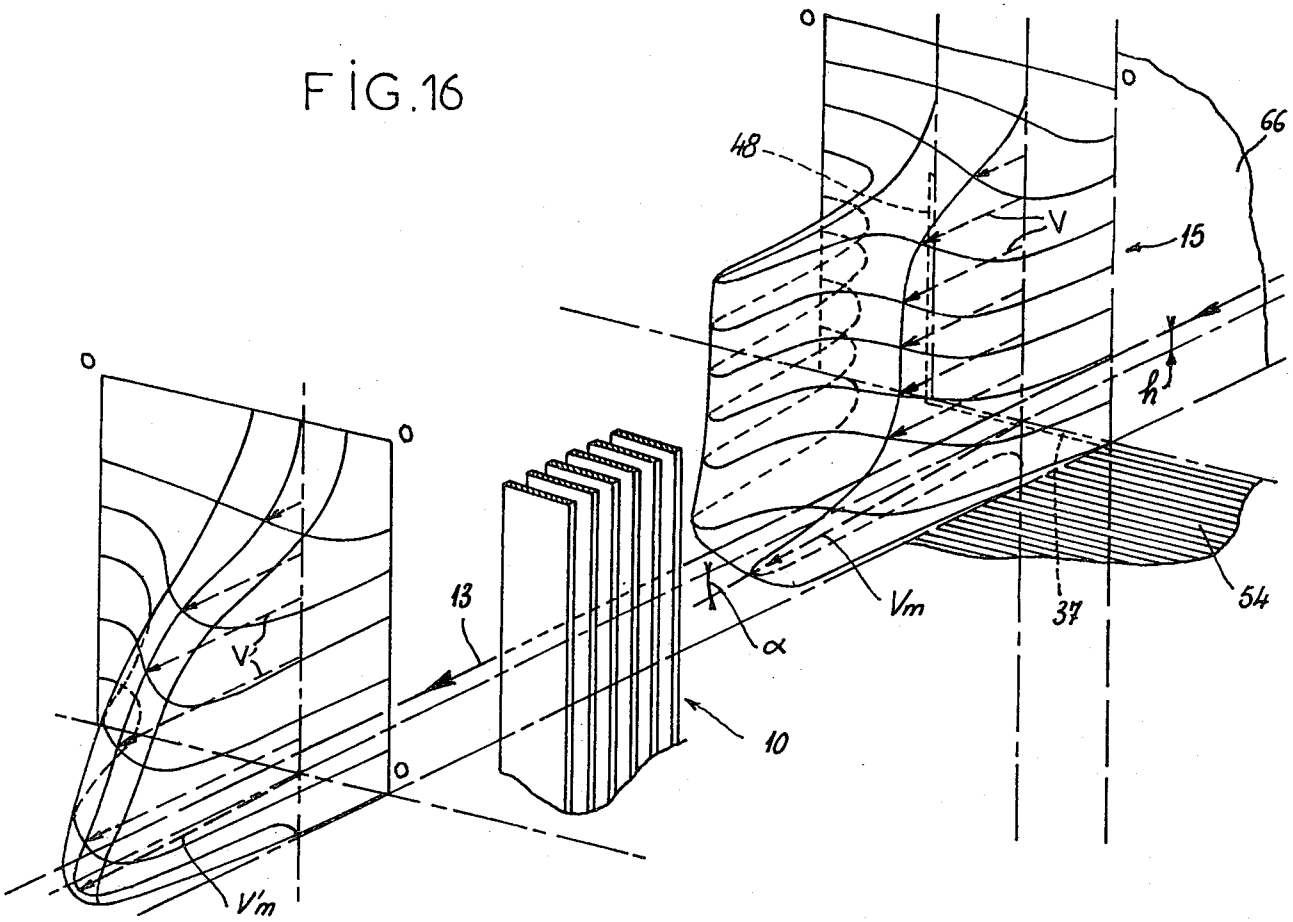
FIG. 16 is a diagram of the air speeds of the fluid, in the plane of an auxiliary nozzle in FIGS. 11 to 15 and at a mid-point between two such auxiliary nozzles.

Finally, FIG. 16, similar to FIG. 9, illustrates, in the case of the asymmetrical auxiliary nozzles previously described, the nature of the air speeds V in the plane of an auxiliary nozzle 15 (in fact these are speeds obtained just downstream of the slots 37 and 48) and air speeds V' between two consecutive auxiliary nozzles, at a mid-point of the latter. It will be seen that in the region of an auxiliary nozzle 15, the flow is in the form of "curtains", the area of maximum speeds Vm corresponding to the positions of the two slots 37 and 48, whereas at a mid-point between two auxiliary nozzles, the area of maximum speeds V'm is located in the plane of passage of the weft thread 13, which itself passes at a slight height h above the lower shed of warp threads 54. In addition, it will be noted that the speed increases rapidly from zero in the vicinity of the plane 66 which limits the comb 10 on the side facing the auxiliary nozzles 15. One thus obtains a result which is substantially identical to that observed in the case of symmetrical auxiliary nozzles with three air outlet slots. Moreover and as shown in FIG. 16, the maximum speeds Vm at the outlet of the lower slot 37 have a downwards inclination according to the angle of dip $\alpha$ defined by the shape given to this slot.

Naturally, the invention is not limited to the embodiments of this auxiliary nozzle which have been described above by way of example. On the contrary, it includes all variations based on the same principle and which may vary in particular from the examples described by the detail of their shapes or method of manufacture and it is quite clear that all equivalent solutions, in particular as regards the construction of the means for securing the auxiliary nozzle, remain within the scope of the present invention.

What is claimed is:

1. An active auxiliary nozzle for a shuttle-less loom with pneumatic weft insertion, comprising:

a chamber connected to a compressed air supply source;

means defining a horizontal air outlet slot connected to said source; and means defining at least one vertical air outlet slot to produce, downstream of the auxiliary nozzle, in a direction of weft displacement, a substantially horizontal lower flat jet and at least one lateral flat jet substantially parallel to a comb of the loom, the means defining said horizontal air outlet slot being oriented to direct said lower flat jet slightly downwardly away from the weft.

2. An active auxiliary nozzle as defined in claim 1, in which the slots are in a U-shaped configuration with the horizontal air outlet slot located between two vertical air outlet slots forming the arms of the U, to produce, downstream of the auxiliary nozzles, the flat lower jet and two flat lateral jets.

3. An active auxiliary nozzle as defined in claim 2, in which the two vertical air outlet slots are orientated along planes which are slightly convergent.

4. An active auxiliary nozzle as defined in claim 3, in which the angle of convergence is of the order of 4° to 10°.

5. An active auxiliary nozzle as defined in claim 2, claim 3 or claim 4 in which the two vertical air outlet slots are symmetrical one with the other to produce two lateral jets of the same capacity.

6. An active auxiliary nozzle as defined in claim 2, claim 3 or claim 4, in which the two vertical air outlet slots are asymmetrical one with the other to produce two lateral jets of different capacities.

7. An active auxiliary nozzle as defined in claim 1, in which there is a single said vertical air outlet slot located adjacent that end of the horizontal slot on the side which is remote from the comb, the two slots being in an L-shaped configuration.

8. An active auxiliary nozzle as defined in claim 1, in which the horizontal slot is extended by a concave wall to cause a deflection of the lower jet to a desired inclination, by the effect of the jet attaching itself to the wall.

9. An active auxiliary nozzle as defined in claim 8, in which the angle of inclination of the lower jet is of the order of 4° to 8°.

10. An active auxiliary nozzle as defined in claim 1, further comprising a solid recessed part provided with means for attachment to a comb support of the loom, at least one thin-walled member being connected to the solid part and defining at least one said vertical air outlet slot, and the solid part being provided with an orifice to which a compressed air supply conduit is connected.

11. An active auxiliary nozzle as defined in claim 10, in which the solid part has an upper side formed with an opening therein closed by an inserted thin member, and the solid part is formed with said concave wall which in combination with the thin member, defines the horizontal air outlet slot.

12. An active auxiliary nozzle as defined in claim 11, in which the said solid part is arranged to create local lifting of the lower shed of warp threads, upstream of the auxiliary nozzle.

13. An active auxiliary nozzle as defined in claim 10, in which the solid part has a front portion with an opening therein, and two thin-walled members are inserted and attached and define both the horizontal air outlet slot and the vertical air outlet slot or slots.

14. An active auxiliary nozzle as defined in claim 13, in which a wing for supporting the lower shed of warp thread is parallel to the comb and mounted on the thin-walled members.

15. An active auxiliary nozzle as defined in claim 11, in which an inserted thin-walled member defining a vertical air outlet slot is terminated by a point for ensuring the separation of warp threads upstream and downstream of the auxiliary nozzle.

16. An active auxiliary nozzle as defined in claim 10, in which said vertical air outlet slot is set back with respect to a transverse plane tangential to a front face of the thin-walled member defining the vertical slot.

* * * * *